US006019561A

United States Patent [19]

Thomson et al.

[11] Patent Number: 6,019,561

[45] Date of Patent: Feb. 1, 2000

[54] DEVICE FOR ERECTING A WALL

[76] Inventors: Shane Thomson, 10021 E. 96th St., Kansas City, Mo. 64134; Lee Sweeney, 7113 Michael La., Pleasant Valley, Mo. 64068

[21] Appl. No.: 09/039,951

[22] Filed: Mar. 16, 1998

[51] Int. Cl.[7] ..... E04G 21/14

[52] U.S. Cl. ..... 414/11; 414/21; 52/DIG. 1; 52/749; 254/352; 254/334

[58] Field of Search ..... 414/10, 11, 21; 52/749.1, DIG. 1; 254/286, 333, 334, 335, 338, 352

[56] References Cited

U.S. PATENT DOCUMENTS

| | | | |
|---|---|---|---|
| 4,695,028 | 9/1987 | Hunter | 414/11 |
| 4,733,844 | 3/1988 | Molloy | 414/11 |
| 4,928,916 | 5/1990 | Molloy | 414/11 |
| 5,129,774 | 7/1992 | Balseiro et al. | 414/11 |
| 5,303,899 | 4/1994 | Palya | 414/11 |
| 5,630,696 | 5/1997 | Gordon | 414/11 |

*Primary Examiner*—Christopher P. Ellis
*Assistant Examiner*—Douglas Hess
*Attorney, Agent, or Firm*—Kenneth L Tolar

[57] ABSTRACT

The present invention relates to a collapsible device for assisting a construction worker in erecting a framed wall. The device includes an elongated telescoping arm having a planar foot member at a first end thereof for vertically securing the arm to a floor. A first end of an elongated nylon strap is attached to a retraction mechanism on the arm. A second end of the nylon strap has a bracket thereon for securing to the top of a wall. The telescoping arm has a weight indication means for indicating to a user the weight of a wall being erected thereby. Accordingly, the strap may be secured to a horizontally oriented wall and the nylon strap is retracted causing the wall to pivot to a vertical position. The telescoping arm allows the device to be easily collapsed for transport or storage.

20 Claims, 2 Drawing Sheets

1
2
3
4
5
6
7
8
9
10
11
12
17
18
19
20
21
22
23
26

DEVICE FOR ERECTING A WALL

BACKGROUND OF THE INVENTION

The present invention relates to a device for assisting a construction worker in erecting a framed wall.

DESCRIPTION OF THE PRIOR ART

When constructing a building, construction workers will typically frame each wall with it resting horizontally on the floor. As each wall is completed, it is raised to a vertical position and is permanently secured to the floor. Because these walls are typically extremely heavy, numerous workers are required to pivot the wall to its vertical position. Accordingly, it is often advantageous to employ a lifting device to minimize the number of workers required to lift the wall. Such devices for assisting a construction worker in raising the wall from a horizontal to a vertical position exist in the prior art. Typically these devices are referred to as wall jacks and relate to an elongated rod or pole having a retractable steel cable attached thereto. The elongated rod is vertically secured to the floor and the steel cable is attached to the top of the wall. The cable is then retracted to pivot the wall to a horizontal position.

Several other types of lifting devices for assisting a construction worker exist in the prior art. For example, U.S. Pat. No. 5,129,774 issued to Balseiro et al relates to a sheet rock lifter.

U.S. Pat. No. 4,928,916 issued to Molloy relates to a ceiling panel installation support.

U.S. Pat. No. 4,733,844 issued to Molloy relates to a sheet rock support device.

U.S. Pat. No. 4,695,028 issued to Hunter relates to a device for holding construction materials comprising an outer tube and a shaft slidably disposed therewithin. A support member is mounted to an end of the shaft.

U.S. Pat. No. 5,630,696 issued to Gordon relates to an apparatus for positioning an object including a fixed vertical frame with a wheeled carriage rollably engaging the frame at a first end and rollably engaging the floor at a second end.

U.S. Pat. No. 5,303,899 issued to Palya relates to an apparatus for lifting construction materials such as wall panels comprising a frame having a vertically slidable panel receiving member thereon.

Conventional wall jacks as described above have numerous disadvantages. The retractable steel cable assembly poses a significant safety hazard. The cable is repeatedly subjected to extremely high tension due to the weight of the wall thereby increasing the risk of the cable fraying or breaking. If the cable breaks while subjected to high tension, serious personal injury to those nearby may result. Furthermore, the steel cable is constantly tangling and distorting making it difficult to manipulate. Additionally, these devices typically include an elongated unitary body and cannot be conveniently collapsed or disassembled for transport and storage. Finally, conventional wall jacks have a maximum weight limit which can be unknowingly exceeded thereby posing a significant safety risk for those operating the jack. The present invention overcomes the above enumerated disadvantages by providing a telescoping device that employs a flat, retractable nylon strap for lifting the wall and has an integral weight scale thereon for visually indicating to a user the weight of the wall being lifted thereby.

SUMMARY OF THE INVENTION

The present invention relates to a device for lifting a framed wall from a horizontal to a vertical position. The device comprises a telescoping arm having a pulley at each of two opposing ends thereof. On the exterior surface of the arm is a retraction mechanism of the type generally known in the prior art. Attached to the retraction mechanism and engaging the pulleys is an elongated nylon strap having two opposing ends. A first end of the strap has a T-shaped attachment member for selectively engaging a T-shaped slot on the retraction mechanism. The opposing end of the strap has an elliptical link thereon for securing the strap around an item to be lifted. Alternatively, the link may be selectively secured to an L-shaped bracket for attaching the strap to the top of a wall. Pivotally attached to an end of the telescoping arm is a planar foot member having a plurality of opposed apertures thereon for vertically securing the device to the floor. Attached to the foot member and received within the telescoping arm is a cylindrical shaft which selectively engages a fixed spring within the arm. As the device is lifting a wall, the arm will be displaced downwardly against the bias of the spring. The piston has a plurality of weight indicia thereon visible through an aperture on the telescoping arm for visually indicating the weight of a wall being lifted thereby. It is therefore an object of the present invention to provide a device for lifting a wall that is safe to use and inexpensive to manufacture.

It is yet another object of the present invention to provide a device for lifting a wall which may be conveniently collapsed for transporting or storage.

It is yet another object of the present invention to provide a device for lifting a wall having an integral weight indication means for visually indicating the weight of a wall being lifted thereby. Other objects, features and advantages of the present invention will become readily apparent from the following detailed description of the preferred embodiment when considered with the attached drawings and the appended claims.

DESCRIPTION OF THE PREFERRED EMBODIMENT

Figures 1, 2:
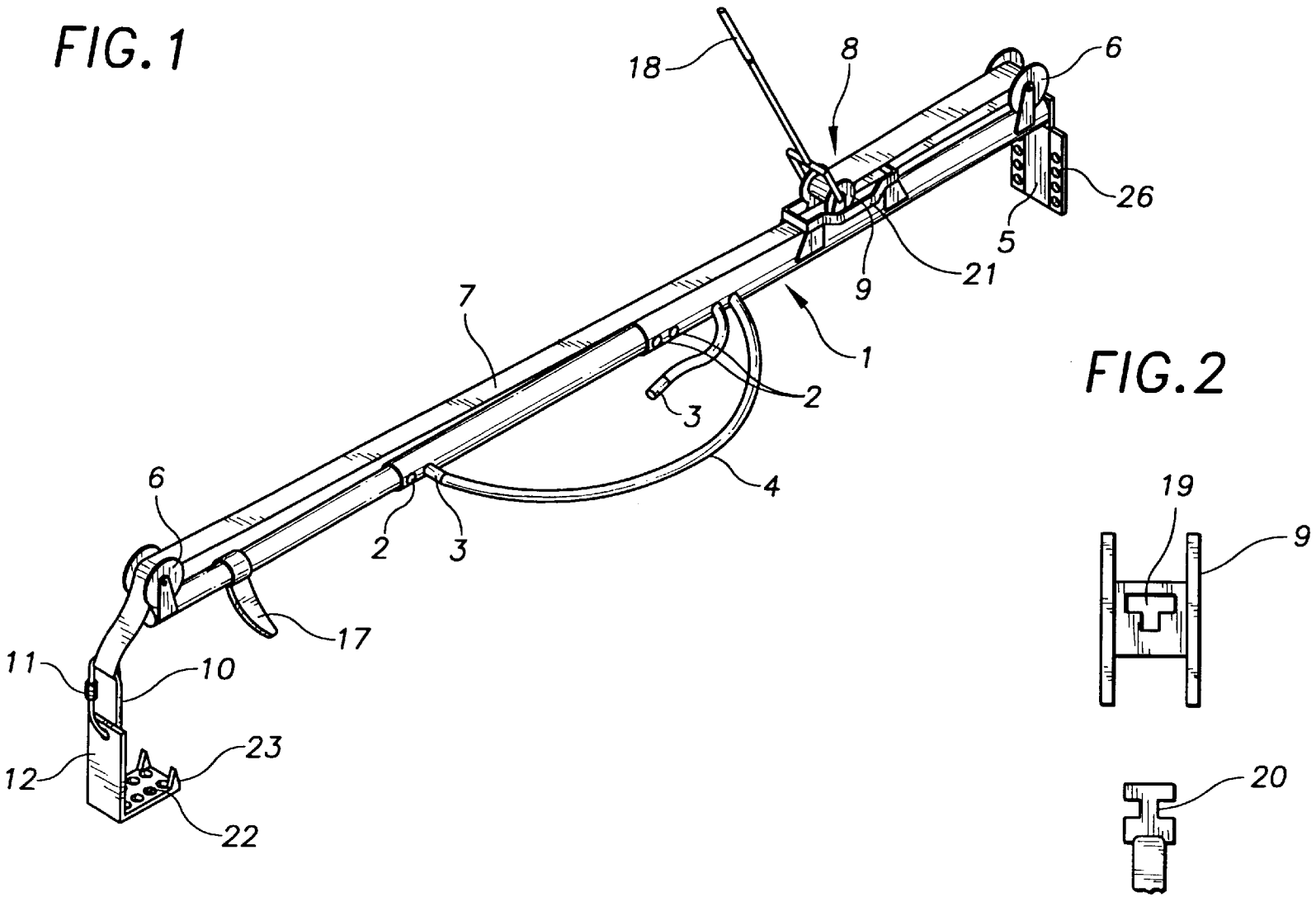
FIG. 1 depicts the inventive device.
FIG. 2 depicts a reel and T-shaped connector relating to the retraction mechanism according to the present invention.
Figure 4:
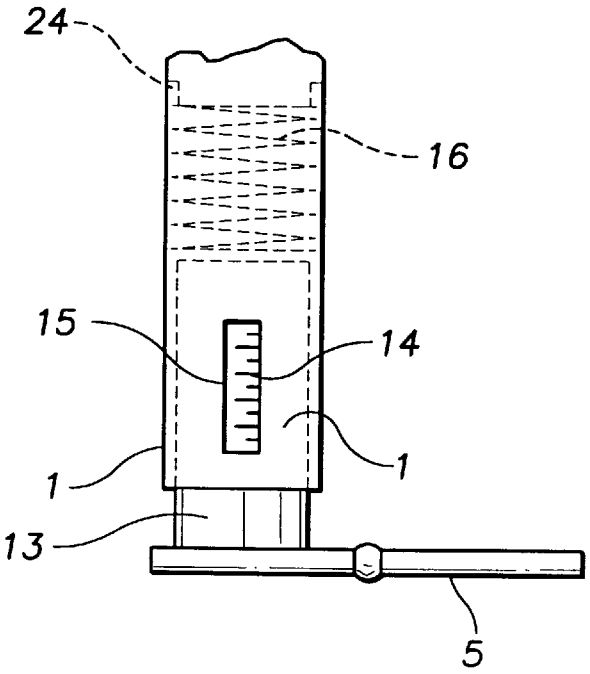
FIG. 4 depicts the weight indication means according to the present invention.

Referring now to FIGS. 1 through 4, the present invention relates to a new and improved wall jack assembly for assisting a construction worker in erecting a framed wall. The device includes an elongated telescoping arm 1 having first and second ends including a plurality of telescoping sections allowing the arm to be collapsed or extended as desired. Each telescoping section has a plurality of apertures 2 thereon for selectively aligning with apertures on an adjacent section. A pin 3 may be inserted into the apertures to lock the arm in an extended position. Each of the pins are secured to the exterior of the arm with a cord 4, a wire, a rope or similar device.

Received within a first end of the telescoping arm is a pivotable planar foot member 5 having a plurality of apertures 26 thereon for vertically securing the telescoping arm to a floor adjacent the horizontally disposed wall. A pulley 6 is disposed at each end of the telescoping arm for rotatably engaging a strap 7.

The strap 7 is substantially planar with a pair of opposing terminal ends and is preferably constructed with nylon or a similar durable material. The strap has a substantially T-shaped connector 20 at a first end thereof for securing the strap to the retraction mechanism. The strap 7 engages each of the pulleys which guide the strap as it is extended or retracted. On the exterior surface of the telescoping arm is a retraction mechanism 8 of the type generally known in the prior art for selectively extending or retracting the strap. The retraction mechanism includes a reel 9 having a ratcheting mechanism therein for scrollably receiving the strap with a handle 18 operatively attached to a side thereof. The reel is secured to the arm with a bracket 21 or a similar mounting means. The reel is irreversibly rotatable in either direction to incrementally retract or extend the strap. The reel and ratcheting mechanism are of the type generally known in the prior art which is sometimes referred to as a "comealong." The reel has a substantially T-shaped slot 19 thereon for receiving the T-shaped connector 20 on the strap.

Figure 3:
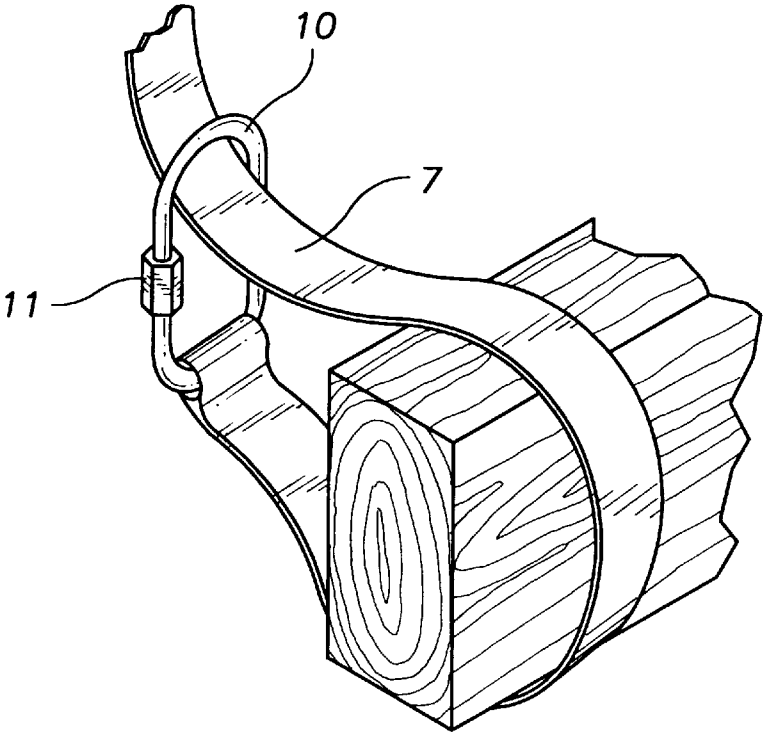
FIG. 3 depicts the strap according to the present invention secured around a beam.

Attached to a second end of the strap is an elliptical link 10 that is severable with a connector 11. The elliptical link 10 may be used to secure the strap around a wall beam or similar item as depicted in FIG. 3. Alternatively, the link may be attached to a substantially L-shaped bracket 12 having a plurality of apertures 22 thereon for receiving a fastener means such as a nail or screw to secure the bracket to the top of a wall. The bracket 12 also has a plurality of spikes 23 depending therefrom for penetrating the exterior surface of a wall.

Perpendicularly depending from the pivotable foot member 5 and received within a first end of the telescoping arm is a cylindrical shaft 13 having a plurality of weight indicia 14 thereon. The weight indica 14 are visible through a substantially rectangular opening 15 disposed on the outer surface of the telescoping arm. Immediately above the cylindrical shaft is a coil spring 16 the opposing end of which abuts an inner portion of the telescoping arm such as an annular flange 24 or a transverse partition. An arrow or a similar means (not pictured) may be disposed adjacent the rectangular opening for aligning with a weight mark on the shaft. Accordingly, as a wall is being lifted, the telescoping arm will be displaced downwardly relative to the shaft against the bias of the spring. The relative displacement of the arm will depend upon the weight of the wall which may be visually determined by viewing the indicia appearing within the rectangular opening.

On the exterior surface of the telescoping arm proximal the second end thereof is a wall stop member 17. The stop member 17 is axially slidable along the telescoping arm to vary the position thereof. The stop member 17 engages the top of the wall on a side opposite the telescoping arm to prevent the wall from falling backward as it is lifted to vertical position. As the top of the wall is being lifted, the pivoting foot member allows the telescoping arm to pivot as necessary to continue lifting the wall.

The above described device is not to be limited to the exact details of construction enumerated above. For example, the device may be used to lift a variety of objects in addition to framed wall sections. The telescoping arm is preferably constructed with steel and the strap is preferably constructed with nylon. However, as will be readily apparent to those skilled in the art, the materials of construction, the shape and size of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A device for erecting a wall comprising:

a substantially hollow elongated arm including a plurality of telescoping sections, said arm having two opposing ends and an exterior surface;

an attachment means at a first end of said telescoping arm for vertically attaching said arm to a support surface;

a retraction mechanism disposed on the exterior surface of said telescoping arm;

an elongated planar strap, having two terminal ends, a first end of which is attached to said retraction mechanism with a securing means at a second end thereof;

a reel attached to the exterior surface of said arm;

a handle operatively attached to said reel for rotating said reel in a select irreversible direction to extend or retract said strap;

the first pulley at a first end of said telescoping arm and the second pulley at a second end of said telescoping arm, each pulley for rotatably engaging said strap to guide said strap along said telescoping arm.

2. A device for erecting a wall according to claim 1, wherein said telescoping sections each further include:

an aperture for aligning with an aperture on an adjacent section;

a pin means received within said aligned apertures for locking said telescoping arm in an extended position.

3. A device for erecting a wall according to claim 2 wherein said pin means are secured to the exterior surface of said arm with a cord means.

4. A device for erecting a wall according to claim 1, wherein said first end of said strap has a substantially T-shaped attachment thereon for selectively engaging a T-shaped slot on said reel.

5. A device for erecting a wall according to claim 1, further comprising a weight indication means received within a first end of said telescoping arm.

6. A device for erecting a wall according to claim 5, wherein said means for attaching said telescoping arm to the support surface comprises a pivotable planar foot member having a plurality of apertures thereon for receiving a fastener means.

7. A device for erecting a wall according to claim 6, wherein said weight indication means comprises:

a substantially cylindrical shaft extending from said foot member and received within a first end of said telescoping arm;

a spring disposed between a distal end of said shaft and an inner portion of said telescoping arm;

a plurality of weight indicia on the exterior surface of said cylindrical shaft, said indicia visible when aligned with an opening on said telescoping arm.

8. A device for erecting a wall according to claim 1 wherein said securing means comprises an elliptical link for securing said strap about a wall to be lifted.

9. A device for erecting a wall according to claim 8 further comprising a bracket removably attached to said link for attaching said strap to a wall.

10. A device for erecting a wall according to claim 9 wherein said bracket comprises a substantially L-shaped member having a plurality of apertures thereon for receiving a fastener means.

11. A device for erecting a wall according to claim 9 wherein said bracket further comprises a plurality of spike members depending therefrom for penetrating a wall.

12. A device for erecting a wall according to claim 1 further comprising a wall stop member proximal the second end of said arm and slidable thereon for engaging a wall being lifted.

13. A device for erecting a wall comprising:

a substantially hollow elongated arm including a plurality of telescoping sections, said arm having two opposing ends and an exterior surface;

an attachment means at a first end of said telescoping arm for vertically attaching said arm to a support surface;

a retraction mechanism disposed on the exterior surface of said telescoping arm;

an elongated planar strap, having two terminal ends, a first end of which is attached to said retraction mechanism with a securing means at a second end thereof;

a weight indication means received within a first end of said telescoping arm.

14. A device for erecting a wall according to claim 13 wherein said retraction mechanism comprises:

a reel attached to the exterior surface of said arm;

a handle operatively attached to said reel for rotating said reel in a select irreversible direction to extend and retract said strap;

a first pulley at a first end of said telescoping arm and a second pulley at a second end of said telescoping arm, each pulley for rotatably engaging said strap to guide said strap along said telescoping arm.

15. A device for erecting a wall according to claim 13 wherein said telescoping sections each further include:

an aperture for aligning with an aperture on an adjacent section;

a pin means received within said aligned apertures for locking said telescoping arm in an extended position.

16. A device for erecting a wall according to claim 13 wherein the first end of said strap has a substantially T-shaped attachment thereon for selectively engaging a T-shaped slot on said reel.

17. A device for erecting a wall according to claim 13 wherein said means for attaching said telescoping arm to the support surface comprises a pivotable planar foot member having a plurality of apertures thereon for receiving a fastener means.

18. A device for erecting a wall according to claim 17 wherein said weight indication means comprises:

a substantially cylindrical shaft extending from said foot member and received within a first end of said telescoping arm;

a spring disposed between a distal end of said shaft and an inner portion of said telescoping arm;

a plurality of weight indicia on the exterior surface of said cylindrical shaft visible when aligned with an opening on said telescoping arm.

19. A device for erecting a wall according to claim 13 wherein said securing means comprises an elliptical link for securing said strap about an item to be lifted.

20. A device for erecting a wall according to claim 19 further comprising a bracket removably attached to said link for attaching said strap to a wall.

* * * * *